United States Patent [19]

Schmidt et al.

[11] Patent Number: 4,631,829

[45] Date of Patent: Dec. 30, 1986

[54] HAND-HELD SAFETY HOLDER FOR A SINGLE-EDGE RAZOR BLADE FOR CUTTING A SHEET OR STRAND

[75] Inventors: Gerry Schmidt, Newport Beach; Michael McHugh, Huntington Beach, both of Calif.

[73] Assignee: Pacific Handy Cutter, Inc., Costa Mesa, Calif.

[21] Appl. No.: 771,639

[22] Filed: Sep. 3, 1985

[51] Int. Cl.[4] ..... B26B 29/02

[52] U.S. Cl. ..... 30/294; 30/2; 30/317

[58] Field of Search ..... 30/289, 294, 295, 314, 30/317, 2

[56] References Cited

U.S. PATENT DOCUMENTS

| | | | |
|---|---|---|---|
| D. 248,538 | 7/1978 | Richards | D8/99 |
| 2,254,199 | 9/1941 | Baltuch | 30/289 |
| 2,266,916 | 12/1941 | Steele | 30/294 |
| 2,537,287 | 1/1951 | Thomas | 30/317 X |
| 2,593,601 | 4/1952 | Pollak | 30/294 |
| 2,743,523 | 5/1956 | Honey | 30/2 |
| 2,810,194 | 10/1957 | Unsinger | 30/294 X |
| 3,195,231 | 7/1965 | Lightburn | 30/2 |
| 3,406,447 | 10/1968 | Travlos | 30/2 |
| 3,430,339 | 3/1969 | Hobson | 30/2 |
| 3,667,122 | 6/1972 | Black | 30/286 |
| 3,673,687 | 7/1972 | Phillips et al. | 30/294 |
| 4,089,112 | 5/1978 | Richards | 30/162 |
| 4,134,206 | 1/1979 | Beerman | 30/294 |

*Primary Examiner*—Jimmy C. Peters

*Attorney, Agent, or Firm*—Poms, Smith, Lande & Rose

[57] ABSTRACT

A holder is described which holds a conventional, single-edge razor blade and permits the blade to be held safely in the hand and used to cut thin, elongated articles, such as sheets or strands by drawing the blade into edgewise contact with the sheet or strand. The cutting edge of the blade is protected except for a portion thereof, which is exposed at the end of a guide slot in the holder, which serves both to guide the article being cut into cutting contact with the blade at an optimum angle of incidence with respect to the blade, and to prevent other articles and parts of the hand from being cut accidently. The blade is replaceable without tools and is reversible to use portions of both ends. A finger extends outward from the holder and parallel to the guide slot to hook the article to be cut into initial engagement into the guide slot.

10 Claims, 6 Drawing Figures

Fig. 1.
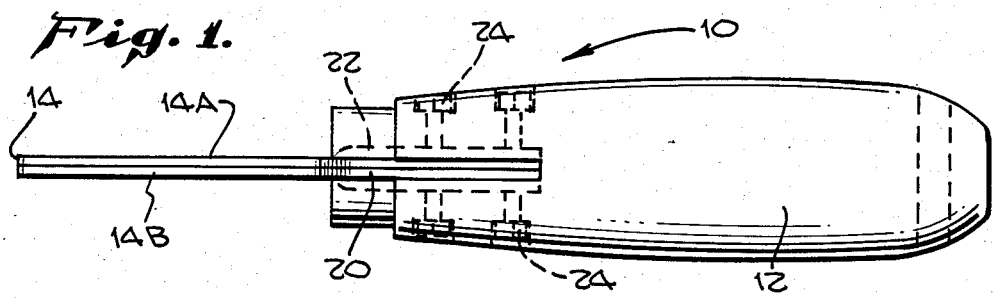
Fig. 2.
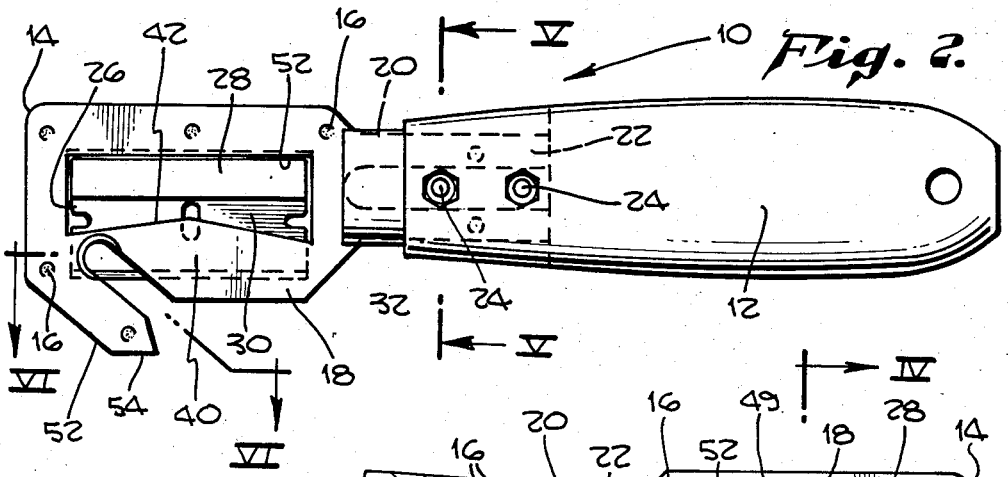
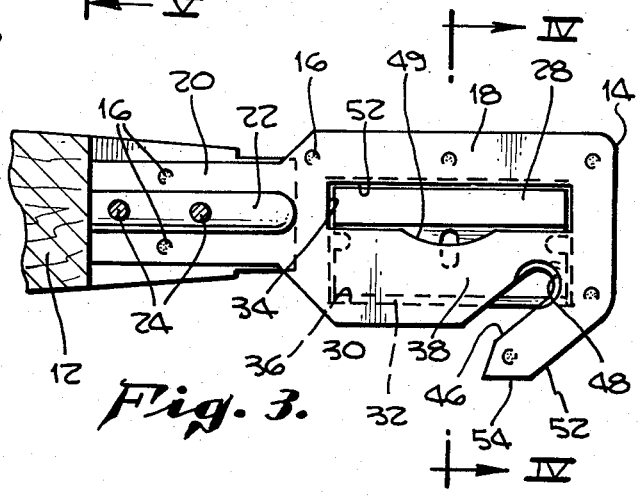
Fig. 3.
Fig. 4.
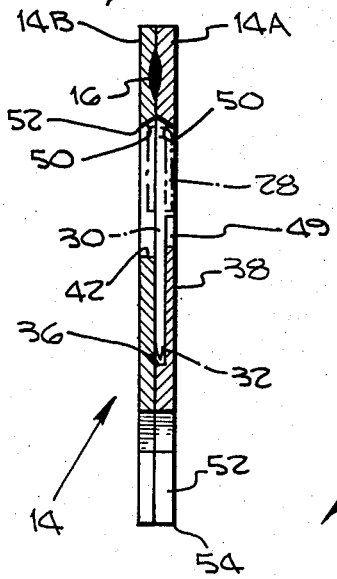
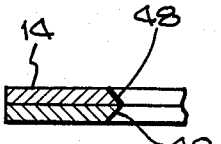
Fig. 6.
Fig. 5.
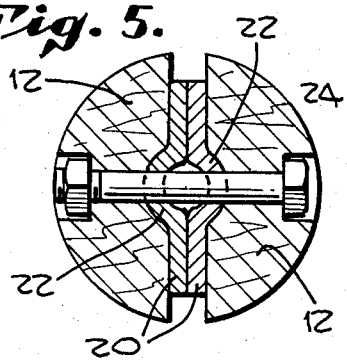

HAND-HELD SAFETY HOLDER FOR A SINGLE-EDGE RAZOR BLADE FOR CUTTING A SHEET OR STRAND

BACKGROUND OF THE INVENTION

1. Field of the Invention

This invention relates, in general, to hand-held cutting tools, and in particular, to a hand-held safety holder which incorporates a conventional, single-edge razor blade, which is adapted for cutting a thin, elongated member such as a sheet or strand and to prevent the accidental cutting of the hand or other articles.

2. Summary of the Prior Art

Hand-held knives find wide application in a disparate variety of fields. A wide variety of knives having specialized purposes have been developed as a result, ranging from the scalpel of the surgeon to the double-edged knife of the oyster-shucker. In a smaller, but equally disparate, group of fields, there is a recognized need for a hand-held knife capable of cutting a strand, e.g., string, rope, fishing line, etc., or a thin sheet, such as a roll of paper, a sheet of film, or a strap.

Typical users include: Personnel engaged in preparation of articles for shipping, who need quickly to cut strapping tape or twine, packaging film or paper; workers in film laboratories engaged in loading, unloading or processing bulk quantities of photographic film; and, rescue workers engaged in extracting occupants of vehicles equipped with safety belts during emergency conditions, such as may occur at racing events, who typically cut the belts with a knife in preference to attempting to operate the buckles of the belts, which may have been rendered inoperative by the crash.

These, and other, widespread applications signal the need for a simple, reliable, inexpensive, hand-held knife which may be carried safely upon the person in the pocket or on a lanyard from the wrist or belt, which is adapted for the cutting of a sheet or strand without the danger of the accidental cutting of the user or other object.

An effect in this direction is the "Knife Handle" of Rollband, et al., found in U.S. Pat. No. 4,242,795. The handle of that invention incorporates a retractable, proprietary, single-edge blade which is actuated by a thumb-button extending through a slot in the top. A slot on the lower edge of the handle permits edgewise cutting contact between a strand or sheet and the cutting edge of the blade, whether the blade is retracted or not, while preventing the cutting contact of the blade with the hand, at least when the blade is retracted.

However, this knife is not well adapted to cutting thicker materials because of the narrow width of the slot, and tends to bind with stiffer materials, particularly stiff sheets, such as poster board and the like, because the depth of the slot and the width of the body are such as to bind with the parted halves of the material being cut before its engagement with the blade, which tends to tear or rip the material, rather than cut it. Further, the knife handle of Rollband, et al., is relatively complicated mechanically, and hence, relatively expensive.

SUMMARY OF THE INVENTION

It is therefore an object of the present invention to provide a holder for holding a sharp blade safely in the hand, which is adapted for cutting a sheet or strand of material.

It is a further object of the present invention to provide such a holder which incorporates a conventional, single-edge razor blade.

It is yet a further object of the present invention to provide such a holder that is sufficiently simple to make, inexpensive and light in weight as to be conveniently carried upon the person and used without danger of cutting the user.

These objects are preferrably achieved in an elongated holder for a conventional, single-edge razor blade which is adapted at one end for grasping with the hand and which has a thin, planar blade-gripping part at the other end which contains a rectangular aperture to retain the guard of the razor blade and restrain the blade from movement in the plane of the blade and a pair of parallel sidewalls containing a blade-receiving recess therebetween to receive and protect the cutting part of the razor blade, at least one of the sidewalls being relieved for a portion of its depth to permit the lateral insertion of the blade into the recess without the use of tools. A guide slot angled outward toward the handle end and inward toward the blade-receiving recess at an angle of about 40° exposes a short portion of the cutting edge of the razor blade and also serves to guide the material to be cut into cutting contact with the blade at an efficient angle of incidence. The width and depth of the guide slot is adapted to permit the edgewise passage of a strand or sheet into cutting contact with the blade, while preventing cutting contact of the blade with other articles, especially parts of the hand of the user. A hooking finger having a tapered end is provided on the blade-gripping part beyond the opening of the guide slot, and parallel and adjacent to it to hook the material to be cut into initial engagement with the opening of the guide slot.

A more complete understanding of the present invention may be had by a consideration of the following description of the preferred embodiment, when perused in conjunction with the accompanying drawings, of which the following is a brief description.

DESCRIPTION OF THE DRAWINGS

FIG. 1 is top view of a holder of the present invention, showing a planar, blade-gripping portion of the holder to the left and a handle portion to the right;

FIG. 2 is a side view of the holder of the present invention, incorporating a conventional single-edge razor blade;

FIG. 3 is a partial side section of the other side of the holder that was illustrated in FIG. 2;

FIG. 4 is a cross section through the planar, blade-gripping part of the holder, as revealed by taking the section IV—IV in FIG. 3;

FIG. 5 is a detailed section through the handle portion of the holder, as revealed by the section V—V taken in FIG. 2;

FIG. 6 is a partial, detail sectional through the end of a guide slot in the planar portion, showing a chamfered edge in the region immediately adjacent to the cutting edge of the blade, as revealed by the section VI—VI taken in FIG. 2.

DESCRIPTION OF THE PREFERRED EMBODIMENTS

FIGS. 1 and 2 illustrate a top and side view of an exemplary, preferred embodiment of the present invention, a hand-held safety holder for a single-edge razor blade for cutting a sheet or strand.

The holder 10 consists of an elongated member having a handle 12 located at the end proximal to the user and a planar, blade-gripping member 14 disposed toward the distal, or working end.

In the preferred embodiment, planar, blade-gripping member 14 comprises a pair of planar side parts 14A and 14B which are substantially symmetrical to each other about one of their edges and which are joined back-to-back by spotwelds 16 obtained in the conventional manner. Planar side parts 14A and 14B are, in the exemplary preferred embodiment illustrated, each stamped from a sheet of strong plate stock, e.g., steel sheet, and may be heat-treated for additional strength. Alternatively, side parts 14A and 14B can be stamped from a single sheet of stock, then folded toward one another about their edge of symmetry before back-to-back joining.

Planar blade-gripping part 14 further comprises a blade-holding part 18 and a tang extension 20 for attachment to handle 12. Tang 20 may be reinforced by forming a pair of dimples 22 into planar side parts 14A and 14B during the stamping operation.

In the exemplary preferred embodiment illustrated, handle 12 is shown to be fabricated from a wood turning and bifurcated for attachment to tang 20 by means of a pair of fasteners 24. However, those skilled in the art will readily recognize that handle 12 may be fabricated from any suitable material, e.g., an injection-molded plastic, and attached to tang 20 by other fastening methods, e.g., adhesive bonding. Alternatively, if sufficient material is provided in tang part 20 during forming, handle part 12 can be fabricated integrally of tang part 20, thereby omitting the need for a separate handle altogether.

Planar member 14 is adapted to receive and hold a conventional, single-edge razor blade 26, of the type which are readily available from groceries, drug stores and hardware outlets. Razor blade 26 typically comprises an upper, blade guard part 28 for gripping the blade between the fingers of the hand of the user without cutting, and a lower, blade part 30, onto the edge of which is formed the sharp, cutting edge 32 of blade 26.

In the preferred embodiment, planar member 14 is provided with an opening for receiving and retaining the blade 26 within holder 10, comprising an upper, rectangular aperture 34 passing through the side parts 14A and 14B which is slightly larger than the guard 28 of the blade 26, to receive and restrain the upper edge of blade 26 against movement in the plane of the blade during cutting, and a lower, internal, blade-receiving recess 36 which is slightly larger than the blade part 30 of razor blade 26, extending downward from the rectangular aperture 34 in the plane of planar member 14 and between a pair of sidewalls 38 and 40 which grip the blade laterally therebetween to hold the blade in place and prevent its movement in the lateral direction during cutting.

In the preferred embodiment illustrated, sidewall 40 is relieved for a portion of its height below rectangular aperture 34 to permit the insertion of the blade into the blade-receiving recess 36 from that side. The upper edge 42 of sidewall 40 is configured to include an inverted V profile to facilitate a slight outward bending movement of sidewall 40 during insertion of blade 26 into blade-receiving recess 36. Similarly, sidewall 38 contains a thumb-recess 49 along its upper edge to permit the user to press the guard 28 of razor blade 26 out of retangular aperature 34 from that side of holder 10.

In the preferred embodiment illustrated, blade-receiving recess 36 is formed between sidewalls 38 and 40 by removal of a portion of the interior surface of sidewall 38, e.g., by a machining or coining operation. Sidewall 40 retains the same thickness throughout its depth. However, it may be equally desirable to machine or coin half of blade-receiving recess 36 into the interior surfaces of both sidewalls 38 and 40 before they are joined, or it may be desirable to stamp the details of recess 36 into one or both of sidewalls 38 and/or 40 during the stamping operation. Regardless of the particular forming operation selected, what is desirable is that blade-receiving recess 36 have a thickness slightly less than the thickness of the blade part 30 of razor blade 26, such that sidewalls 38 and 40 must be sprung outward by the blade 30 during its insertion therebetween to grip and hold the blade more firmly therebetween after insertion. To that further end, spotwelds 16 are illustrated in the preferred embodiment as being disposed around the top edge and distal end of planar member 14, and omitted from the lower edge of member 14 below blade-receiving recess 36, to permit sidewalls 38 and 40 to hinge outward at the lower edge of blade-receiving recess 36.

Planar member 14 further includes a slotted opening 46 which is angled inward toward the distal end to intersect blade-receiving recess 36 to expose a portion of the cutting edge 32 of blade 26. Slotted opening 46 is angled outward and downward toward the proximal end and serves to guide the sheet or strand into edgewise cutting contact with the exposed part of the cutting edge of blade 26 at an angle of incidence of approximately 40°, which has been found to be optimum for a smooth cutting action, when the holder 10 is drawn into cutting contact with the edge of a sheet or strand. Slotted opening 46 is sufficiently narrow and deep to prevent the accidental cutting contact between the exposed part of the cutting edge of blade 26 and any part of the hand of the user, which is not sufficiently thin or deep to permit it to pass through the edges of the opening 46.

It will be readily appreciated that, since slotted opening 46 exposes only a portion of the cutting edge of blade 26, the user may remove and reverse blade 26 in planar member 14 after the cutting edge has become dulled with use and before replacing blade 26, in order to utilize more of the available cutting surface on a given, single-edge razor blade.

The slotted opening 46 further includes a beveled edge 48 on both sides of planar member 14. In the preferred embodiment illustrated, beveled edge 48 is confined to a region immediately adjacent to the exposed portion of the cutting edge 32 of blade 26, but may easily be extended about the entire periphery of slotted opening 46. This double-chamfered edge permits planar member 14 to present a very thin leading and trailing aspect to the sheet or strand during cutting which is no greater than the blade 26 itself, and to part the sheet or strand smoothly during cutting to prevent binding of the holder or the tearing of the sheet or strand.

Rectangular recess 34 also includes along its upper edge a pair of internally-chamfered surfaces 50 which, in the preferred embodiment, combine to form an inverted V recess along the upper edge of the rectangular aperture 34 to cup and retain the guard 28 of blade 26 in place.

Planar member 14 further includes an elongated finger extension 52 which extends outward and downward below the lower edge of planar member 14, which has a tapered point 54 and is disposed to lie parallel with, and have an edge coincident with, the slotted opening 46, to hook the article to be cut into initial engagement with the slotted opening 46. It is to be noted that, if the taper point 54 of finger extension 52 is made sufficiently sharp, it can be utilized by the wielder of the knife to pierce large sacks of bulk materials e.g., grain, beans, cement, etc. before the sack material itself is pulled into cutting contact with the exposed portion of the blade, thereby adapting the holder 10 for ripping open these types of containers. However, if taper point 54 is made too sharp, the safety aspect of holder 10 is somewhat diminished.

Those practitioners skilled in the art will recognize that materials, methods of fabrication and methods of assembly illustrated and described herein are for purposes of illustration, and may be modified suitably to achieve a variety of individual designs, depending upon the particular application in mind.

Accordingly, the invention as disclosed herein, a hand-held safety holder for a single-edge razor blade for cutting a sheet or strand, should be limited in its scope only by the following claims.

What is claimed is:

1. A hand-held safety holder for a single-edge razor blade, for cutting a thin sheet or strand, comprising:

an elongated member having proximal and distal ends, with a planar, blade-holding part disposed toward said distal end and a part for grasping with the hand disposed toward the other, said planar part having about the same thickness as the guard of the razor blade and first and second sides, said planar part having a rectangular aperture therethrough which is slightly larger than the guard of the razor blade for retaining the blade against movement in the plane of the planar part during cutting, said planar part having an internal, blade-receiving recess which is slightly larger than the blade part of the razor blade, extending downward from said aperture, in the plane of said planar part, and between said first and second sides, said first side being relieved for a portion of its depth below said rectangular aperture to permit the insertion and removal of the blade part of the razor blade between said first and second sides, and to retain the blade therebetween against lateral movement during cutting, said planar part having a slotted opening at the lower edge thereof, extending distally-inward to said recess to expose a portion of the cutting edge of the blade, to guide the sheet or strand into cutting contact with said exposed portion of the blade at an angle of incidence with respect to the blade when said knife is drawn across the edge of the sheet or strand, said slotted opening having a width and depth sufficient to permit the edgewise passage of the sheet or strand into said cutting contact with said blade and to prevent said cutting contact with any part of the hand, said planar part having an elongated finger with a tapered end extending proximally-outward therefrom, below said lower edge and parallel to said slotted opening, having a proximal edge coincident with the distal edge of said slotted opening, to hook the sheet or strand into initial engagement within said slotted opening.

2. The device of claim 1, wherein said planar part further comprises:

a pair of formed plates, each said plate having about half the thickness of the guard of the blade and being substantially symmetrical about an edge to the other, said pair of plates being joined back-to-back to form said elongated member.

3. The device of claim 2, wherein:

said pair of formed plates are formed from a single sheet and folded together about said edge of symmetry before said back-to-back joining thereof.

4. The device of claim 1, 2, or 3, wherein:

said angle of incidence between the sheet or strand and the blade is about 40°.

5. The device of claim 1, 2 or 3, wherein:

said slotted opening has a chamfered edge on both sides of said planar part for at least the region of said edge adjacent to said exposed portion of the blade.

6. The device of claim 5, wherein:

the upper edge of said rectangular aperture is chamfered inwardly on both sides of said planar part for the length of said upper edge to form an inverted V therein, to cup the guard of the blade therein during cutting.

7. The device of claim 6, further comprising:

a handle, attached to said part, for grasping with the hand, said handle having an aperture therethrough for hanging said holder therefrom.

8. For mounting a single-edge razor blade of the type having a thin, rectangular blade part with a sharpened edge at the bottom, and a thick, rectangular guard part at the top for gripping between the fingers, a safety knife, comprising:

a pair of flat, parallel plates, each said plate being about half the thickness of said guard part, said plates being joined in a side-by-side assembly defining a blade-receiving space therebetween, said blade-receiving space including a thin, lower, rectangular opening between said plates to receive and retain said blade part, and an upper, rectangular opening through both of said plates to receive and retain said guard part, one of said plates containing a relief into said space for a portion of its depth below said rectangular opening to permit insertion and removal of said blade through the side of said assembly and into said space without further disassembly, said plates further containing a slotted opening through said plates to expose a portion of said sharpened edge, said opening being sufficiently narrow and deep to prevent the entry therein of any part of a hand.

9. The knife of claim 8, wherein:

said parallel plates further include an elongated member extending outwardly from said plates, parallel with, and adjacent to, said slotted opening, said elongated member having a tapered point at its outward end.

10. The knife of claim 8, wherein:

said slotted opening is angled with respect to said cutting edge of said blade at an angle of about 40 degrees.

* * * * *